US010895386B2

(12) United States Patent
Zecevic et al.

(10) Patent No.: US 10,895,386 B2
(45) Date of Patent: Jan. 19, 2021

(54) KITCHEN EXTRACTOR HOOD WITH VORTEX FLOW

(71) Applicant: B.S. SERVICE S.R.L., Fabriano (IT)

(72) Inventors: Nebojsa Neno Zecevic, Jesi (IT); Lorenzo Biagini, Fabriano (IT)

( * ) Notice: Subject to any disclaimer, the term of this patent is extended or adjusted under 35 U.S.C. 154(b) by 155 days.

(21) Appl. No.: 16/310,535

(22) PCT Filed: Jul. 7, 2016

(86) PCT No.: PCT/IT2016/000169
§ 371 (c)(1),
(2) Date: Dec. 17, 2018

(87) PCT Pub. No.: WO2018/008044
PCT Pub. Date: Jan. 11, 2018

(65) Prior Publication Data

US 2019/0331344 A1 Oct. 31, 2019

(51) Int. Cl.
*F24C 15/20* (2006.01)

(52) U.S. Cl.
CPC ..... *F24C 15/2042* (2013.01)

(58) Field of Classification Search
CPC ..... F24C 15/2028; F24C 15/2042
See application file for complete search history.

(56) References Cited

U.S. PATENT DOCUMENTS 1,899,704 A * 2/1933 Lutz ..... E01C 23/14 126/271.2 A
6,620,038 B1 * 9/2003 Kikuchi ..... F24F 7/06 126/299 D
7,959,696 B2 * 6/2011 Martic ..... F24C 15/2028 55/344
2012/0037144 A1 * 2/2012 Corleoni ..... F24C 15/20 126/299 R
2016/0161129 A1 6/2016 Huang

FOREIGN PATENT DOCUMENTS

EP 1118820 A1 7/2001
EP 1887286 A2 * 2/2008 ..... F24C 15/20
EP 1887286 A2 2/2008
EP 2196737 A1 6/2010
WO 2008148712 A2 12/2008

OTHER PUBLICATIONS

International Search Report for PCT/IT2016/000169.
International Preliminary Report on Patentability Chapter I or PCT/IT2016/000169.

* cited by examiner

*Primary Examiner* — Jorge A Pereiro
*Assistant Examiner* — Logan P Jones
(74) *Attorney, Agent, or Firm* — Egbert, McDaniel & Swartz, PLLC

(57) ABSTRACT

An extractor hood has a box body, an extractor fan with at least one inlet in communication with an internal chamber of the box body, a delivery fan with an inlet in communication with the internal chamber of the box body and a delivery outlet in communication with a delivery conduit, a distributor disposed at the end of the delivery conduit. The distributor has an annular body and a plurality of deflector fins that protrude from the internal surface of the annular body in such a way to generate at least one vortex-shaped flow that rotates around the axis of the distributor under the distributor and in front of the opening of the base portion of the box body through which fumes are extracted.

7 Claims, 10 Drawing Sheets

KITCHEN EXTRACTOR HOOD WITH VORTEX FLOW

The present patent application for industrial invention relates to a kitchen extractor hood with vortex flow.

Generally, an extractor hood comprises a box body that houses a fan actuated by an electrical motor, which creates a depression in the box body in such a way to extract the fumes rising from a cooktop. In order to ensure that all the fumes rising from the cooktop are conveyed inside the box body of the hood, the box body must be very large and the electrical motor of the fan must be very powerful. Therefore, such a hood is impaired by the large volume of the hood body and by the noise of the fan motor.

Said drawbacks are solved in WO2008148712 that discloses an extractor hood comprising an extraction conduit and one or more delivery conduit disposed in such a way to generate air flows faced towards the cooktop that make air extraction from the extraction conduit of the hood easier.

WO2008148712 discloses an embodiment wherein the extraction conduit is disposed coaxially inside the delivery conduit. Only in this case, a deflector is disposed inside the delivery conduit comprising an annular distributor provided with a plurality of deflector fins. Each deflector fin of the distributor is disposed according to an axis inclined by an angle, different from zero, with respect to the radial axis passing through the deflector fin and the center of the distributor. In this way the distributor generates an airflow shaped as a vortex, with a helicoidal profile that extends around the airflow extracted by the hood. Such a vortex airflow acts as pneumatic screen around the extracted airflow in such a way to convey the fumes extracted from the cooktop inside the pneumatic screen generated by the distributor.

WO2008148712 discloses other embodiments wherein the delivery conduit is not coaxial with the extraction conduit; however, in these embodiments no distributor intended to generate a vortex is provided in the delivery conduit, and therefore a non-vortical airflow comes out from the delivery conduit, which is not very effective to intercept the fumes rising from the cooktop and convey said fumes towards the extraction conduit.

The purpose of the present invention is to eliminate the drawbacks of the prior art by devising a kitchen extractor hood with vortex flow that is effective and efficacious in extracting the fumes, also in case of high-power burners.

Another purpose of the present invention is to provide such an extractor hood that is not cumbersome and is noiseless.

These purposes are achieved according to the invention with the characteristics of the independent claim 1.

Advantageous embodiments appear from the dependent claims.

The extractor hood of the invention comprises:

- a box body having a base portion intended to be disposed above a cooktop; said box body defining an internal chamber,
- an extractor fan with at least one inlet in communication with said internal chamber of the box body, in such a way to create a depression in the internal chamber of the box body to extract fumes from the cooktop through an opening of said base portion of the box body,
- a delivery fan with one inlet in communication with said internal chamber of the box body and one outlet in communication with a delivery conduit having one end disposed in said base portion of the box body, before said opening of the base portion of the box body through which the fumes are extracted,
- a distributor disposed at the end of said delivery conduit.

The distributor comprises an annular body with an internal surface with truncated-conical shape having an axis that coincides with the axis of the distributor and a plurality of deflector fins that protrude from the internal surface of the annular body towards the inside of the distributor.

The deflector fins are inclined with an angle different from zero with respect to a radial straight line passing through the axis of the distributor and a junction line of the deflector fin to the internal surface of the annular body of the distributor.

Such a layout of the deflector fins generates at least one vortex-shaped flow that rotates around the axis of the distributor, under the distributor and in front of the opening of the base portion of the box body through which the fumes are extracted. Such a vortex-shaped flow intercepts the fumes extracted from the cooktop and conveys said fumes towards the fume inlet opening of the base of the box body of the extractor hood.

Additional features of the invention will appear clearer from the detailed description below, which refers to merely illustrative, not limiting embodiments, wherein.

Figure 1:
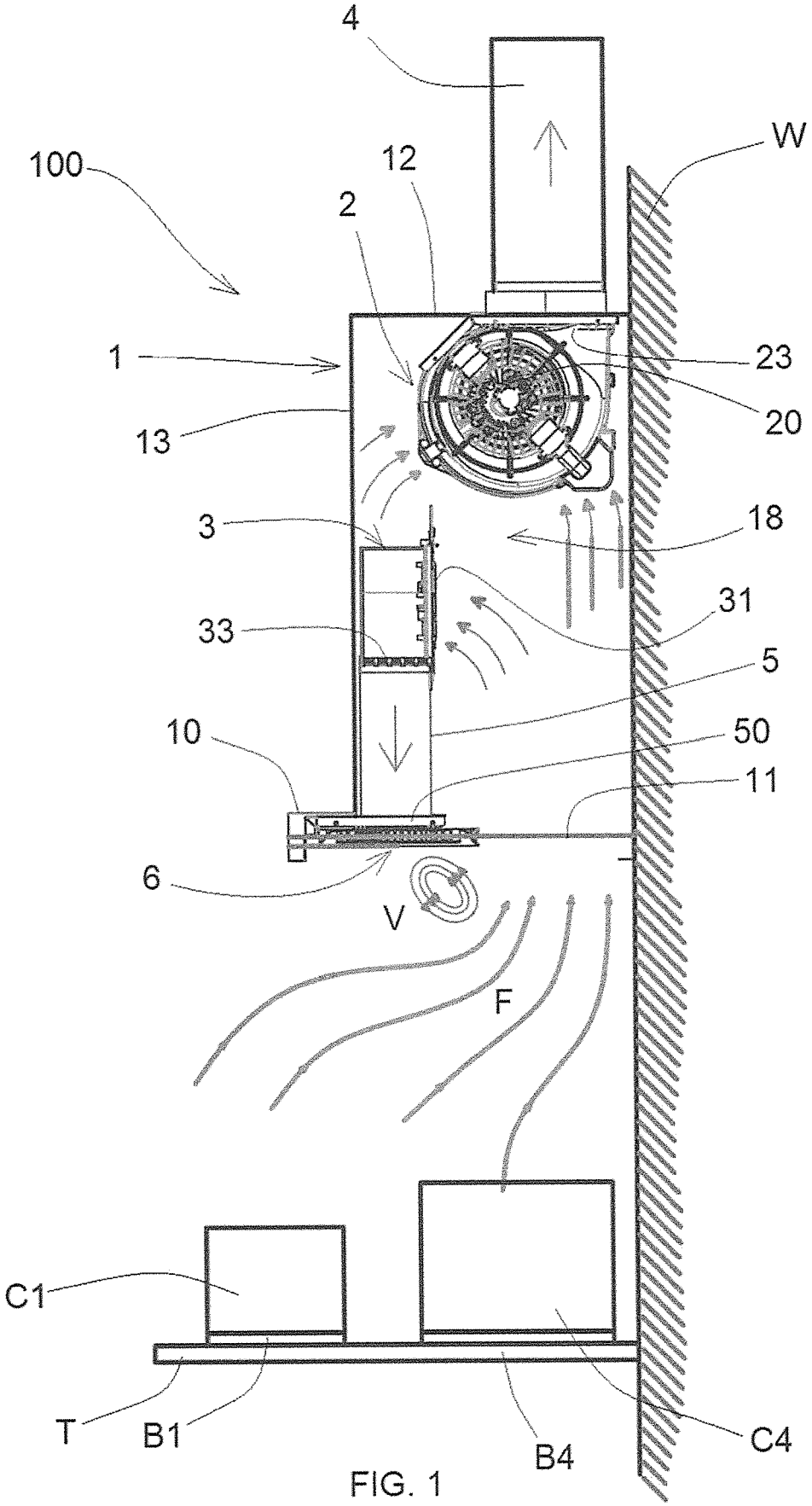
FIG. 1 is a side view of the extractor hood of the invention.
Figure 2:
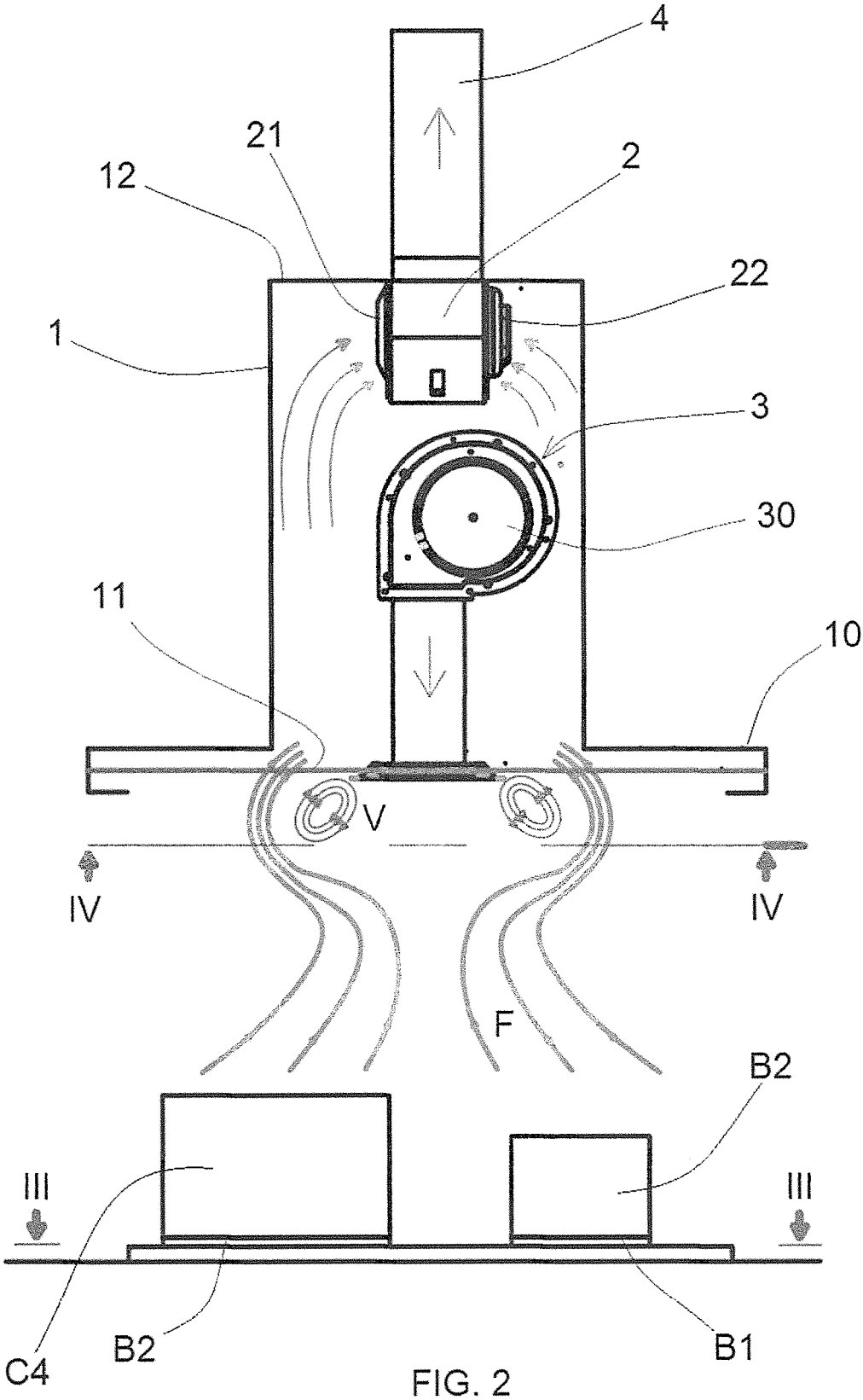
FIG. 2 is a front view of the extractor hood of the invention.
Figure 3:
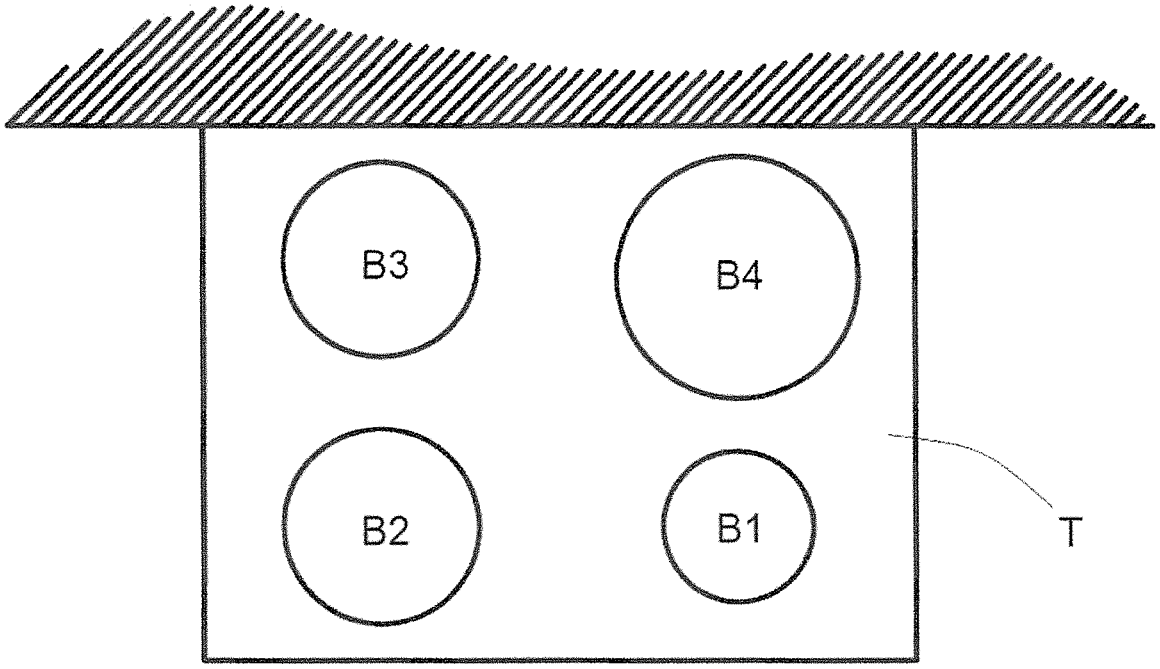
FIG. 3 is a top view of the cooktop taken along the plane III-III of FIG. 2.
Figure 4:
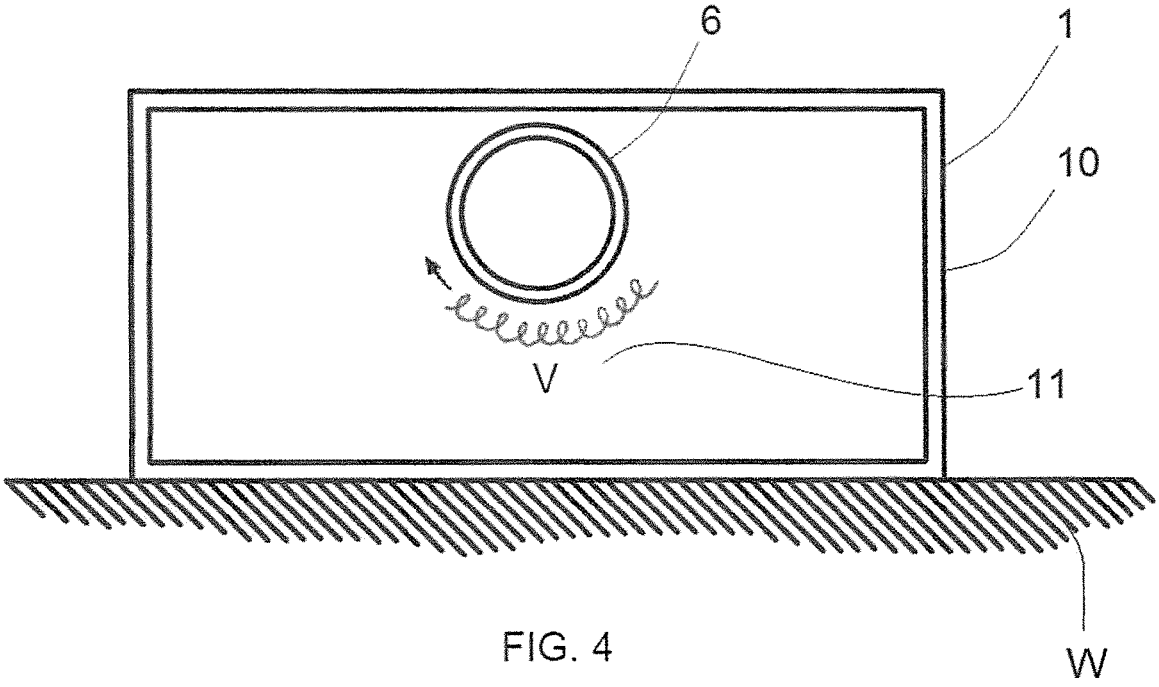
FIG. 4 is a bottom view of the extractor hood taken along the plane IV-IV of FIG. 2.

With reference to the Figures, the extractor hood is disclosed according to the invention, which is generally indicated with reference numeral 100.

Now with reference to FIGS. 1-4, the extractor hood (100) is intended to be disposed above a cooktop (T) comprising a plurality of burners (B1, B2, B3, B4) above which cooking vessels (C1, C4) are to be placed. Two cooking vessels are shown for illustrative purposes: a smaller cooking vessel (C1) disposed on the less powerful burner (B1) and a larger cooking vessel (C4) disposed on the more powerful burner (B4).

The extractor hood (100) comprises a box body (1) with substantially parallepiped shape that defines an internal chamber (18). The box body (1) has a base portion (10) that protrudes outwards with respect to the box body in such a way to be disposed above the cooktop (T). The box body (1) is fixed to a masonry wall (W).

An extractor fan (2) is mounted inside the internal chamber (18) of the box body (1). Preferably, the extractor fan (2) is disposed under an upper wall (12) of the box body in central position. The extractor fan (2) is actuated by an electrical motor (20). The extractor fan comprises two inlets (21, 22) and one outlet (23). The inlets (21, 22) of the extractor fan (2) are in communication with the internal chamber (18) of the box body (1). The outlet (23) of the extractor fan is in communication with a suction conduit (4) that comes out from the box body, crossing the upper wall (12) of the box body.

In case of an extractor hood with filtering function only, the suction conduit (4) is not provided and the outlet (23) of the extractor fan discharges in the box body (1) of the extractor hood.

The base portion (10) of the box body (1) of the extractor hood is open on the bottom and is provided with an opening (11) in communication with the internal chamber of the box body through which air can pass. The opening (11) of the base portion of the extractor hood is covered by filters (of known type and not shown in the figures) intended to let the air pass and filter impurities, such as fats and fumes.

In this way, the extractor fan (2) creates a depression inside the box body (1) and the fumes (F) coming from the cooking vessels (C1, C4) are extracted inside the box body (1) and conveyed from the extractor fan (2) towards the suction conduit (4).

A delivery fan (3) is mounted inside the internal chamber (18) of the box body (1). Preferably, the delivery fan (3) is disposed behind a front wall (13) of the box body in central position under the extractor fan (2). The delivery fan (3) is actuated by an electrical motor (30). The delivery fan comprises one inlet (31) and one outlet (33). The inlet (31) of the delivery fan (2) is in communication with the internal chamber (18) of the box body (1). The outlet (33) of the delivery fan is in communication with a delivery conduit (5) that extends inside the internal chamber (18) of the box body (1) under the delivery fan (3). The delivery conduit (5) has a lower end (50) in correspondence of the base (10) of the extractor hood.

A distributor or diffuser (6) is mounted at the lower end (50) of the delivery conduit. The distributor (6) is suitable for generating at least one vortex-shaped airflow (V), that is to say an airflow with helical direction that rotates around a vertical axis that coincides with the axis of the distributor.

The vortex-shaped airflow (V) pushes the fumes (F) coming from the cooking vessels towards the opening (11) of the box body, allowing the extractor hood to perform a more complete and more effective extraction.

Moreover, such a layout according to which the delivery fan (3) is mounted inside the box body (1) allows increasing the extraction efficiency of the fumes (F) from the cooktop. In fact, fumes extraction is performed both by the extractor fan (2) and by the delivery fan (3), making it possible to underdimension the two fans (2, 3) and minimize the noise of the fans.

Figure 5:
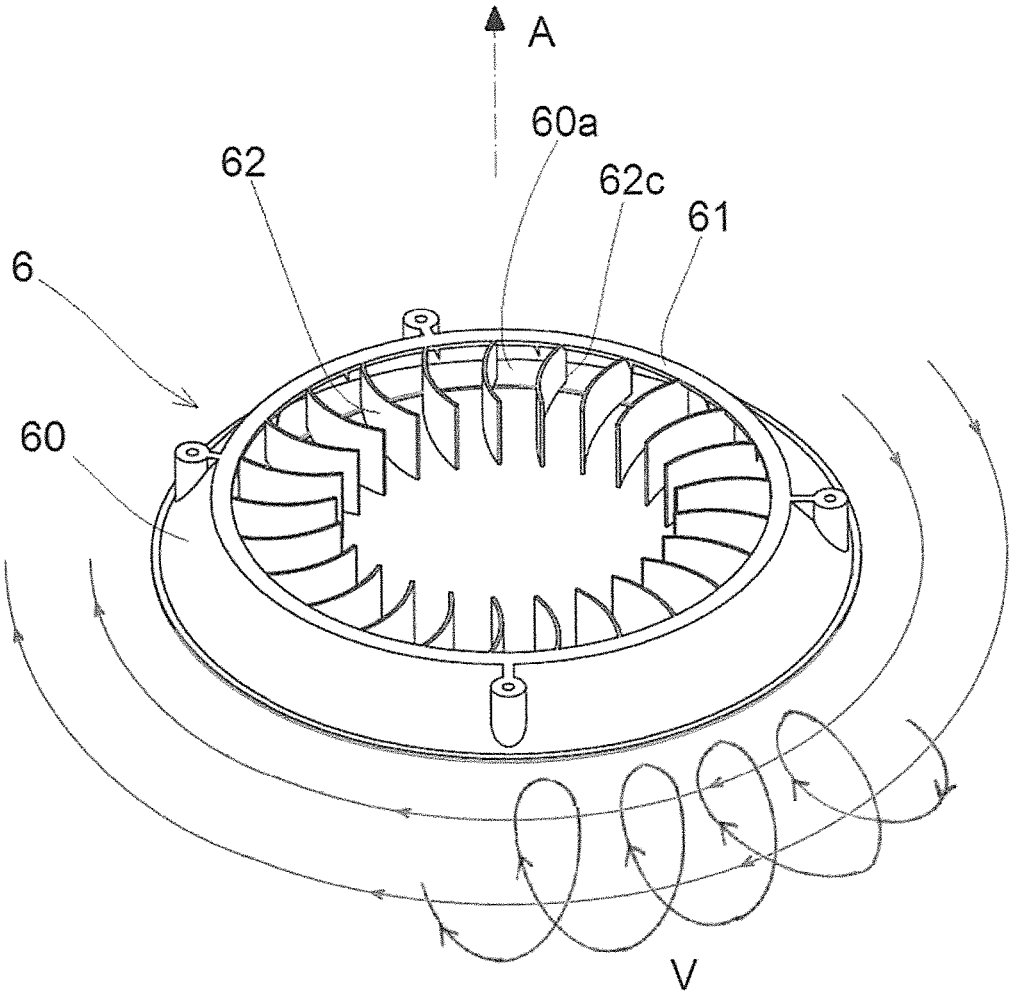
FIG. 5 is a perspective view of a distributor of the extractor hood of FIG. 1.
Figure 6:
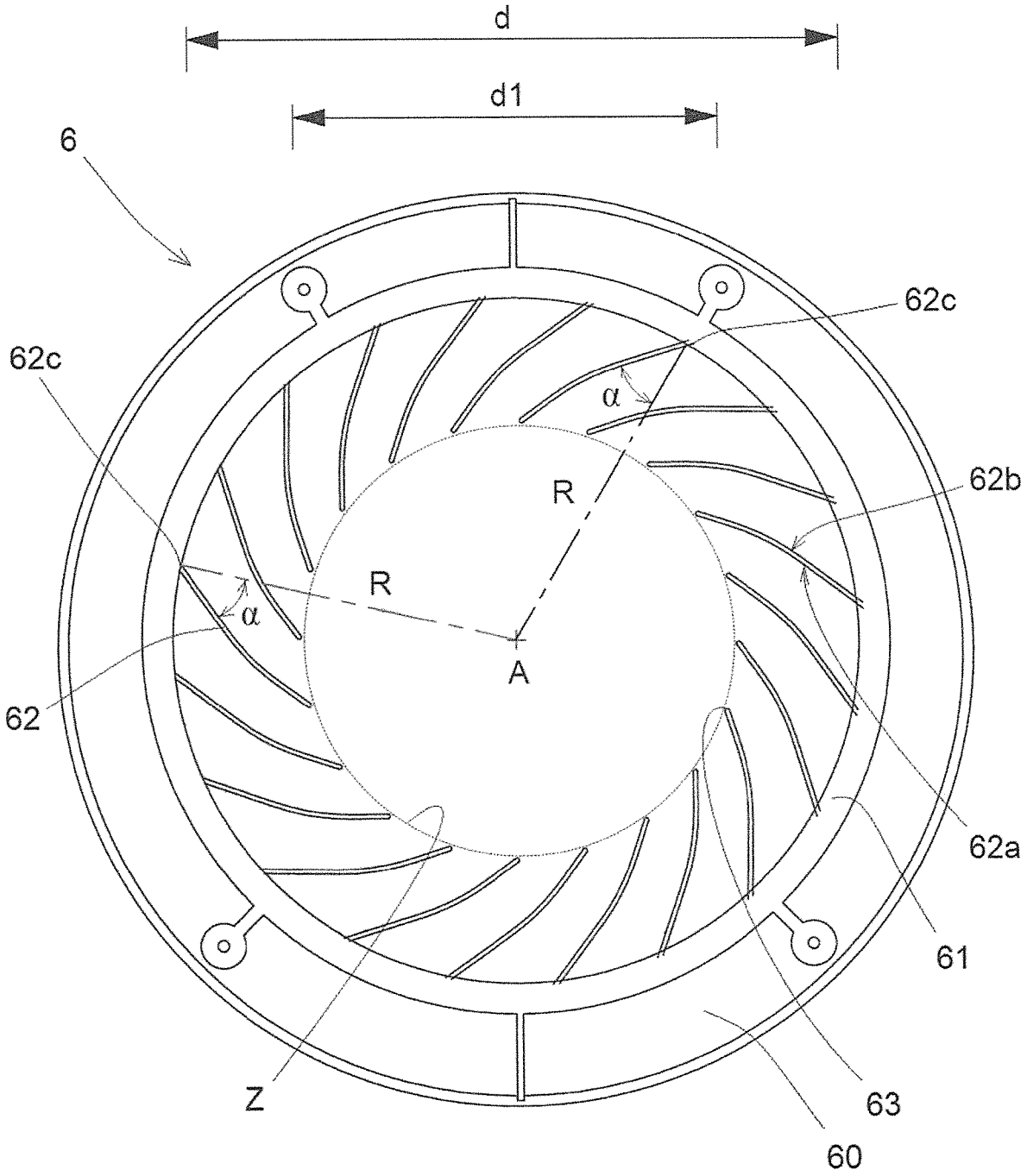
FIG. 6 is a top view of the distributor of FIG. 5.

With reference to FIGS. 5 and 6, the distributor (6) according to a first embodiment comprises an annular body (60). The annular body (60) has an internal surface (60*a*) with truncated-conical shape having an axis (A) that coincides with the axis of the distributor. The annular body (60) has an upper border (61) with internal diameter (d).

A plurality of deflector fins (62) protrude towards the inside of the internal surface (60*a*) of the annular body. The deflector fins (62) are connected to the internal surface (60*a*) of the annular body along junction lines (62*c*). Each deflector fin (62) is curved and is provided with a concave part (62*a*) and a convex part (62*b*).

Each deflector fin (62) is not disposed radially, but it is inclined by an angle (α) with respect to a radial straight line (R) passing through the axis (A) of the distributor and the junction line (62*c*) of the fin. The angle (α) is measured in clockwise direction from the radial straight line (R) towards the deflector fin (62). The angle (α) can range from 20° to 70°, but is preferably comprised between 40° and 50°.

Each deflector fin (62) has a length comprised between ¼ and ⅓ of the internal diameter (d) of the upper border. In this way, the ending edges (63) of each fin are disposed on a circumference (Z) (shown with a broken line) with diameter (d1) and center passing through the axis (A) of the distributor. The diameter (d1) of the circumference (Z) is approximately ½-¾ of the diameter (d) of the upper border (61) of the distributor.

The deflector fins (62) are equally spaced. All deflector fins have the same shape and the same inclination with respect to the radial straight line (R). With such a configuration only one vortex (V) is obtained, which come out from the bottom of the distributor (6) and rotates in clockwise direction around the axis (A) of the distributor along a helical trajectory, as shown in FIG. 5.

Figure 7:
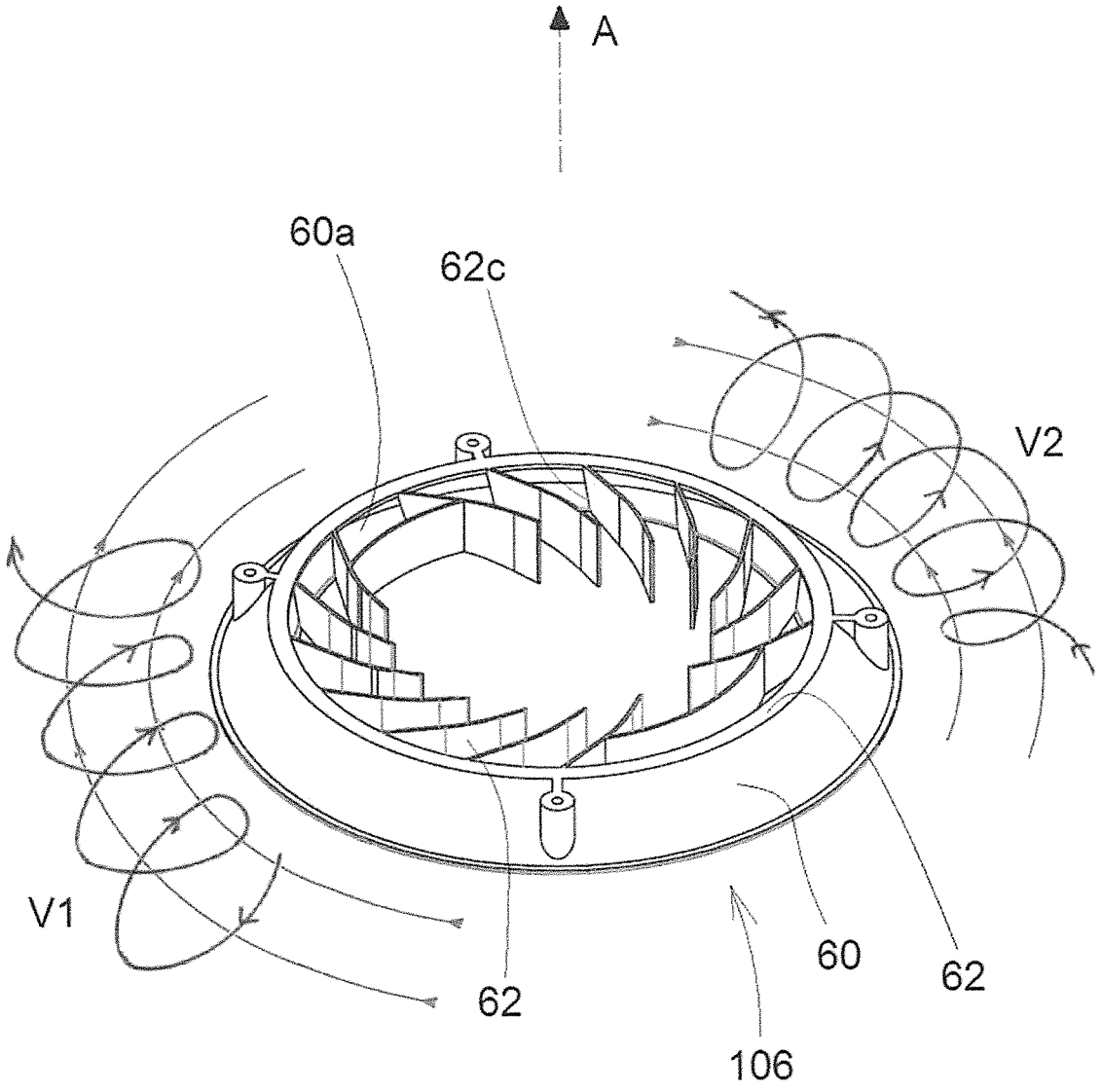
FIG. 7 is a perspective view of a second embodiment of the distributor of the extractor hood of FIG. 1.
Figure 8:
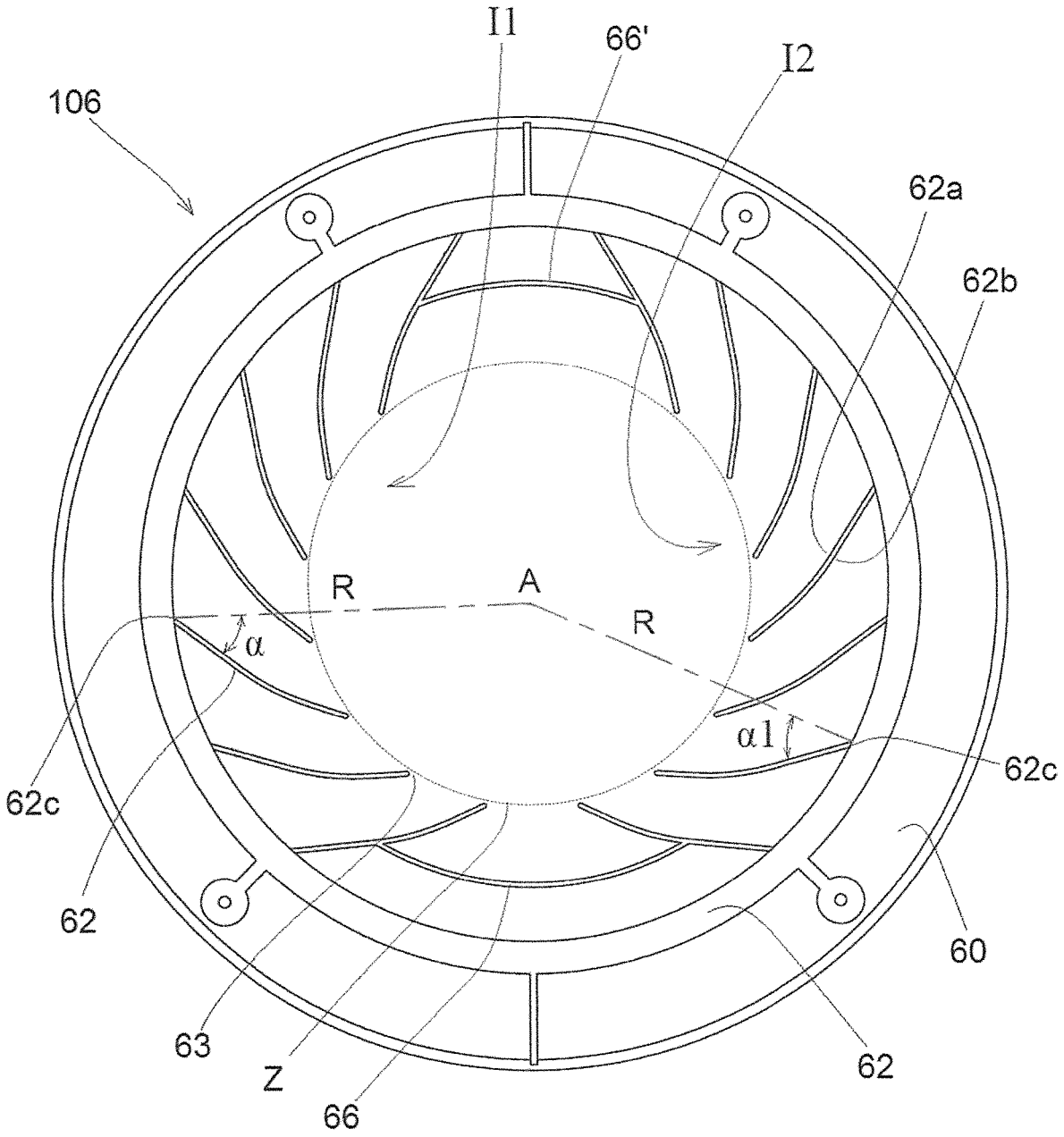
FIG. 8 is a top view of the distributor of FIG. 7.

With reference to FIGS. 7 and 8, a distributor (106) according to a second embodiment is disclosed. The distributor (106) is perfectly interchangeable with the distributor (6) and can be applied in the extractor hood (100) instead of the distributor (6).

The distributor (106) comprises:

- a first set (I1) of deflector fins (62) that extend for half of the distributor circumference, that is to say for approximately 180°; and
- a second set (I1) of deflector fins (62) disposed symmetrically to the deflector fins of the first set (I1) with respect to the distributor diameter.

In view of the above, each deflector fin (62) of the second set (I2) is inclined by an angle (α1) with respect to a radial straight line (R) passing through the axis (A) of the distributor and the junction line (62*c*) of the fin. The inclination angle (α1) of the fins of the second set (I2) is identical to the angle (α) of inclination of the fins of the first set (I1). However, in this case, the inclination angle (α1) of the fins of the second set (I2) is measured in anticlockwise direction from the radial straight line (R) towards the concave part (62*a*) of the deflector wing.

A first connection fin (66) connects the first fin of the first set (I1) with the last fin of the second set (I2).

A second connection fin (66') connects the last fin of the first set (I1) with the first fin of the second set (I2).

The connection fins (66, 66') are disposed in diametrally opposite positions with respect to the axis (A) of the distributor (106). The connection fins (66, 66') are curved with concavity facing towards the axis of the distributor and centre of curvature that coincides with the axis (A) of the distributor.

With such a configuration of the distributor, illustrated in FIGS. 7 and 8, two vortexes (V1, V2) that come out from the bottom of the distributor (6) are obtained. The first vortex (V1) rotates in clockwise direction around the axis (A) of the distributor along a helicoidal trajectory. The second vortex (V2) rotates in anticlockwise direction around the axis (A) of the distributor along a helicoidal trajectory.

Figure 9:
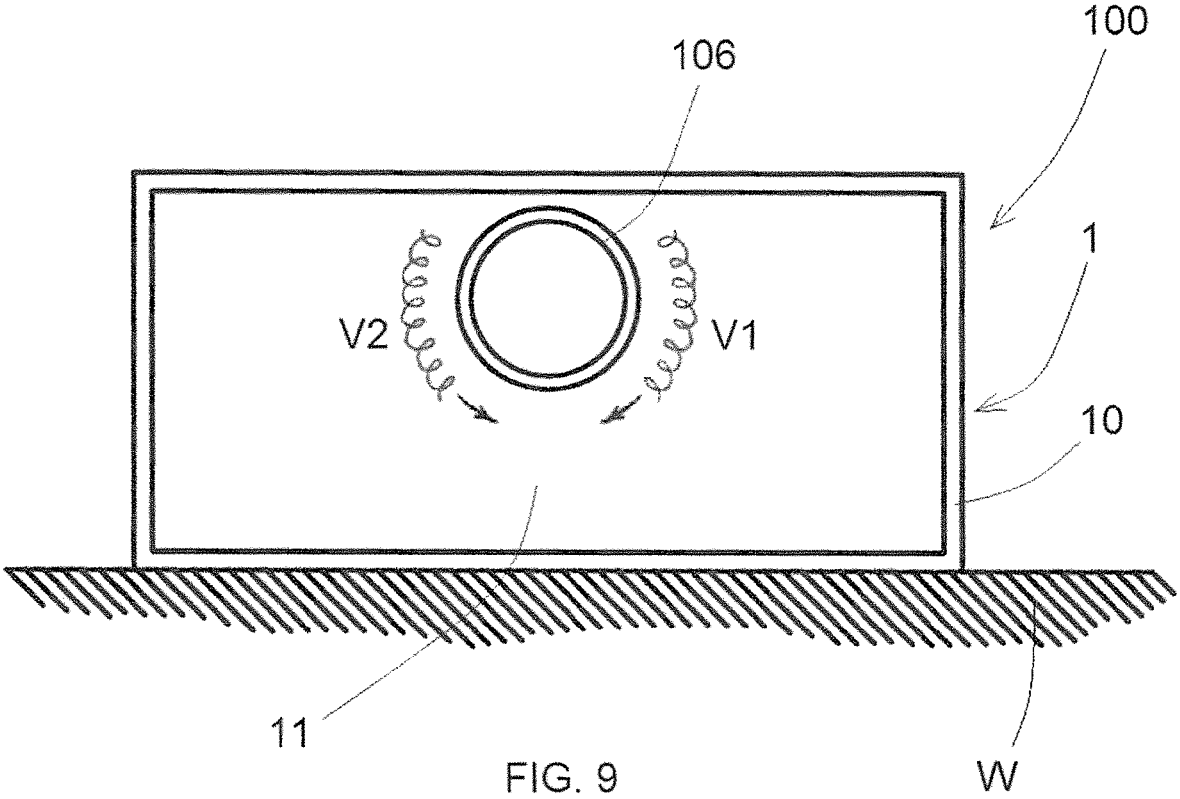
FIG. 9 is a bottom view of the extractor hood according to the invention with the distributor of FIG. 7.

With reference to FIG. 9, the distributor (106) is mounted in the hood (100) in such a way that the two vortexes (V1, V2) meet in a position of the opening (11) of the box body of the hood disposed behind the distributor (106). In this way, the vortexes (V1, V2) coming from the distributor invest from opposite positions the fumes coming from the cooktop (T), in such a way to compress and convey them efficiently towards the opening (11) of the box body of the hood disposed behind the distributor (106).

Figure 10:
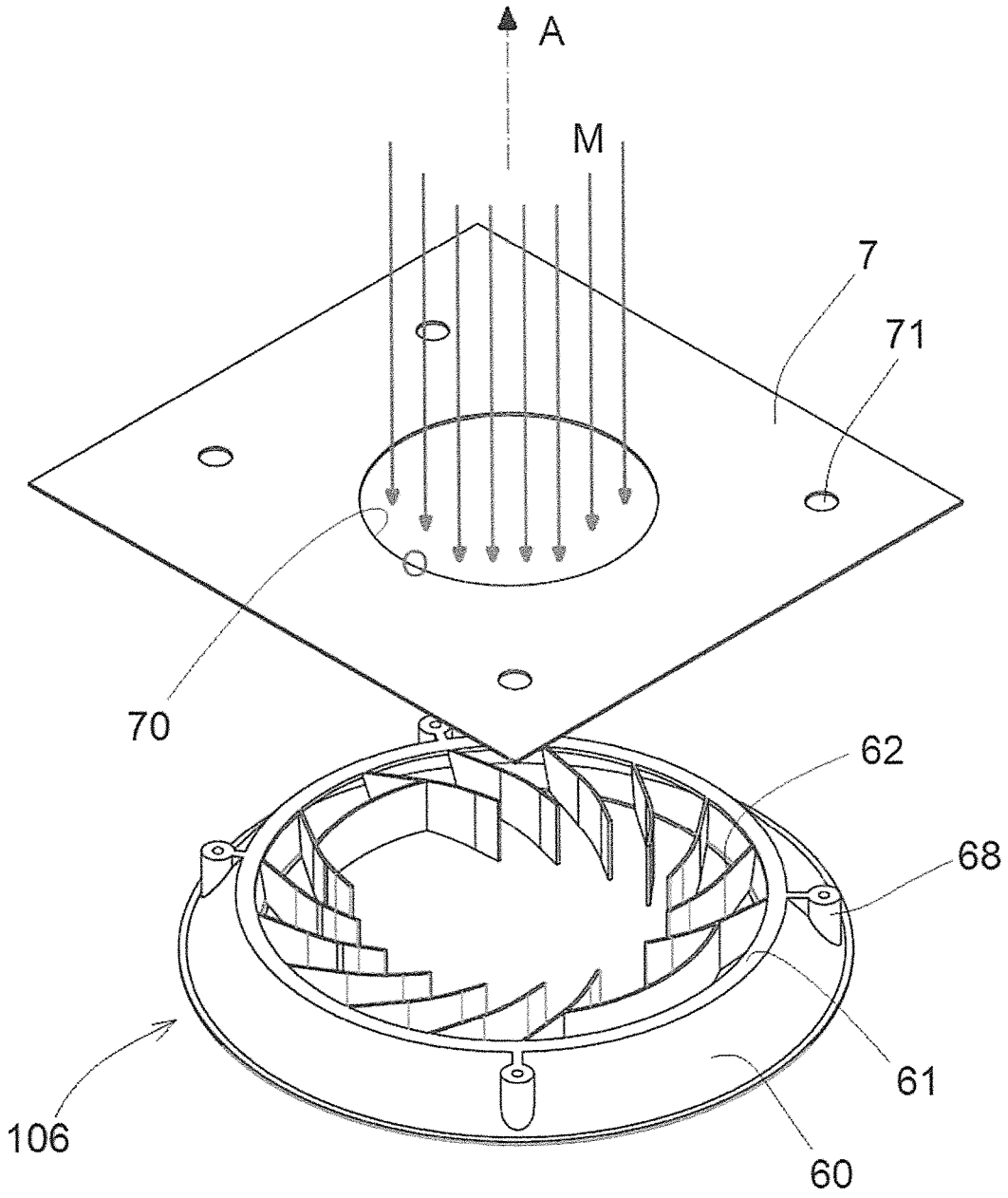
FIG. 10 is an exploded perspective view of the distributor of FIG. 7 and a flange.

With reference to FIG. 10, on the distributor (106) a flange (7) shaped as a plate with a hole (70) is mounted on the distributor, for letting the delivery air (M) sent from the delivery conduit (5) pass. The flange (7) is disposed on the upper border (61) of the distributor. The hole (70) of the flange has a diameter that is identical to or lower than the diameter (d1) of the circumference (Z) passing by the ending edges (63) of the deflector fins. In such a way all the deflector fins (63) are disposed under the flanges (7). The delivery air (M) follows a cylindrical flow in the delivery conduit (5) and expands under the flange (7) in the annular body (60) of the distributor (106), passing through the deflector fins (62) that contribute to generate the vortexes (V1, V2).

The flange (7) has fixing holes (71) to receive fixing means, such as screws, that are engaged in shanks (68) provided in the annular body (60) of the distributor.

The flange (7) can be also mounted on the distributor (6) of the first embodiment of FIGS. 5 and 6.

Figure 11:
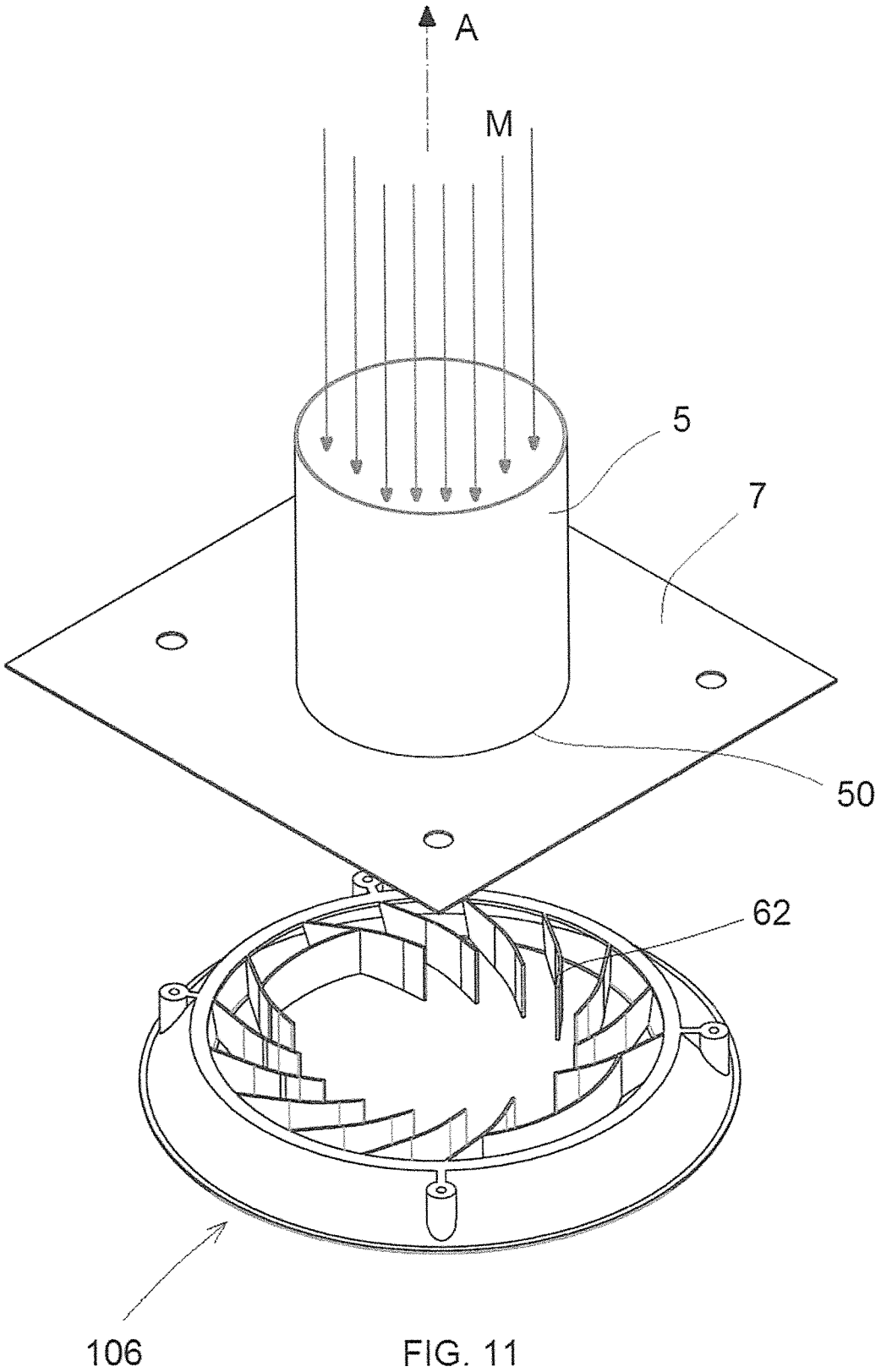
FIG. 11 is an exploded perspective view of the distributor and the flange of FIG. 10, with a delivery conduit applied to the flange.

With reference to FIG. 11, the delivery conduit (5) has an internal diameter that is substantially equal to the diameter of the hole (70) of the flange and is disposed on the hole (70) of the flange. The axis of the delivery conduit (5) passes through the center of the hole (70) of the flange and coincides with the axis (A) of the distributor.

Numerous variations and modifications can be made to the present embodiments of the invention, which are within the reach of an expert of the field, falling in any case within the scope of the invention as disclosed by the attached claims.

The invention claimed is:

1. An extractor hood comprising:

a box body having a base portion adapted to be disposed above a cooktop, said box body defining an internal chamber;

an extractor fan with at least one inlet in communication with the internal chamber of said box body so as to define a depression in the internal chamber of said box body to extract fumes from the cooktop through an opening of the base portion of said box body;

a delivery fan with one inlet in communication with the internal chamber of said box body and one outlet in communication with a delivery conduit having one end disposed in the base portion of said box body before the opening of the base portion of said box body through which the fumes are extracted; and a distributor disposed at the one end of the delivery conduit, said distributor comprising an annular body with an internal surface with a truncated-conical shape having an axis that coincides with an axis of said distributor, said distributor further comprising a plurality of deflector fins that protrude from the internal surface of the annular body towards an inside of said distributor, the plurality of deflector fins being inclined by an angle different from zero with respect to a radial straight line passing through the axis and a junction line of the plurality of deflector fins to the internal surface of the annular body of said distributor, so as to generate at least one vortex-shaped flow that rotates around the axis under said distributor and in front of the opening of the base portion of said box body through which the fumes are extracted, wherein the plurality of deflector fins have an ending edge and a circumference defined by the ending edges of the plurality of deflector fins, the circumference having a center passing through the axis of said distributor; and a flange disposed above said distributor, said flange having a hole with a center that coincides with the axis of the distributor and a diameter that is less than or identical to a diameter of the circumference, wherein the delivery conduit has an internal diameter that is substantially equal to a diameter of the hole of said flange, the delivery conduit being disposed on the hole of said flange, an axis of the delivery conduit passing through the center of the hole of said flange and coinciding with the axis of said distributor.

2. The extractor hood of claim 1, wherein said inclination angle of the plurality of deflector fins with respect to the radial straight line is between 40° and 50°.

3. The extractor hood of claim 1, wherein the plurality of deflector fins have a curved shape with a concave part and a convex part.

4. The extractor hood of claim 1, wherein the plurality of deflector fins are equally spaced from each other, wherein each deflector fin is inclined with respect to the radial straight line by the angle that extends in clockwise direction from the radial straight line to the deflector fin to obtain a single vortex that comes out from a bottom of said distributor and rotates in clockwise direction around the axis of the distributor along a helicoidal trajectory.

5. An extractor hood comprising:

a box body having a base portion adapted to be disposed above a cooktop, said box body defining an internal chamber;

an extractor fan with at least one inlet in communication with the internal chamber of said box body so as to define a depression in the internal chamber of said box body to extract fumes from the cooktop through an opening of the base portion of said box body;

a delivery fan with one inlet in communication with the internal chamber of said box body and one outlet in communication with a delivery conduit having one end disposed in the base portion of said box body before the opening of the base portion of said box body through which the fumes are extracted; and a distributor disposed at the one end of the delivery conduit, said distributor comprising an annular body with an internal surface with a truncated-conical shape having an axis that coincides with an axis of said distributor, said distributor further comprising a plurality of deflector fins that protrude from the internal surface of the annular body towards an inside of said distributor, the plurality of deflector fins being inclined by an angle different from zero with respect to a radial straight line passing through the axis and a junction line of the plurality of deflector fins to the internal surface of the annular body of said distributor, so as to generate at least one vortex-shaped flow that rotates around the axis under said distributor and in front of the opening of the base portion of said box body through which the fumes are extracted; and wherein said distributor comprises:

a first set of deflector fins that extend for half of a circumference of said distributor; and a second set of deflector fins disposed symmetrically to the deflector fins of said first set of deflector fins with respect to a diameter of said distributor to obtain two vortexes that come out from a bottom of said distributor, wherein the first vortex of the two vortexes rotates in a clockwise direction around the axis of the distributor along a helicoidal trajectory, wherein the second vortex of the two vortexes rotates in an anticlockwise direction around the axis of the distributor along a helicolidal trajectory, said distributor being disposed in the extractor hood such that the two vortexes meet in a position of the opening of said box body disposed behind said distributor.

6. The extractor hood of claim 5, wherein an inclination angle of each deflector fin of the first set of deflector fines with respect to the radial straight line is between 40° and 50° and extends in a clockwise direction from the radial straight line to the deflector fin, and wherein the inclination angle of each deflector fin of the second set of deflector fins with respect to the radial straight line is between 40° and 50° and extends in an anticlockwise direction from the radial straight line to the deflector fin.

7. The extractor hood of claim 1, wherein said extractor fan, said delivery fan and said delivery conduit are disposed inside said box body.

* * * * *